US007703874B2

(12) United States Patent
Sagara et al.

(10) Patent No.: US 7,703,874 B2
(45) Date of Patent: Apr. 27, 2010

(54) INKJET HEAD UNIT INCLUDING A PLURALITY OF HEAD ELEMENTS ATTACHED TO ONE ANOTHER AND A COMMON NOZZLE PLATE AND INK DISTRIBUTION MANIFOLD

(75) Inventors: Tomoyuki Sagara, Sakurai (JP); Yoshinori Nakajima, Nara (JP)

(73) Assignee: Sharp Kabushiki Kaisha, Osaka-Shi (JP)

( * ) Notice: Subject to any disclaimer, the term of this patent is extended or adjusted under 35 U.S.C. 154(b) by 452 days.

(21) Appl. No.: 11/662,753

(22) PCT Filed: Sep. 8, 2005

(86) PCT No.: PCT/JP2005/016494

§ 371 (c)(1),
(2), (4) Date: Mar. 13, 2007

(87) PCT Pub. No.: WO2006/030683

PCT Pub. Date: Mar. 23, 2006

(65) Prior Publication Data

US 2008/0117257 A1 May 22, 2008

(30) Foreign Application Priority Data

Sep. 15, 2004 (JP) ..... 2004-268543

(51) Int. Cl.
*B41J 29/38* (2006.01)

(52) U.S. Cl. ..... 347/17; 347/68; 347/47; 347/70

(58) Field of Classification Search ..... 347/12, 347/13, 20, 40, 42, 43, 44, 47, 68, 70–72, 347/17, 18.84–87
See application file for complete search history.

(56) References Cited

U.S. PATENT DOCUMENTS 5,327,627 A * 7/1994 Ochiai et al. ..... 347/71
5,971,522 A * 10/1999 Ono et al. ..... 347/40

FOREIGN PATENT DOCUMENTS

| | | |
|---|---|---|
| JP | 05-261942 | 10/1993 |
| JP | 09-174833 | 7/1997 |
| JP | 10-250053 | 9/1998 |
| JP | 2001-341293 | 12/2001 |
| JP | 2001-341298 | 12/2001 |
| JP | 2002-178509 | 6/2002 |

* cited by examiner

*Primary Examiner*—Juanita D Stephens
(74) *Attorney, Agent, or Firm*—Edwards Angell Palmer & Dodge LLP; David G. Conlin; David A. Tucker

(57) ABSTRACT

The inkjet head in accordance with the present invention includes a head unit formed by fixing a plurality of head elements to each other, and a nozzle plate fixed on the head unit. The head element has a pair of main surfaces and a front surface positioned between the pair of main surfaces, and the front surface has a plurality of openings respectively communicated with ink chambers. The head elements forming the head unit are fixed with their main surfaces brought into contact with each other. The nozzle plate is provided in contact with the front surface of the head unit across all the head elements forming the head unit.

9 Claims, 8 Drawing Sheets

INKJET HEAD UNIT INCLUDING A PLURALITY OF HEAD ELEMENTS ATTACHED TO ONE ANOTHER AND A COMMON NOZZLE PLATE AND INK DISTRIBUTION MANIFOLD

TECHNICAL FIELD

The present invention relates to an inkjet head used for an inkjet printer or the like, as well as to a method of manufacturing the inkjet head. More specifically, the present invention relates to an inkjet head formed by combining a plurality of head elements as well as to the method of manufacturing the same.

BACKGROUND ART

In an inkjet printer, small ink droplets are jetted out from small nozzle holes provided at the inkjet head in accordance with print data, whereby an image is printed on a medium such as a sheet of paper. As an inkjet-type printer, one that forms a full color image using an inkjet head filled with ink of four colors, that is, cyan, magenta, yellow and black or six colors additionally including light cyan and light magenta, has been known. Recently, it has become a common practice to fabricate a wiring pattern, a color filter and the like by incorporating the inkjet head in a production system.

FIGS. 13 and 14 show a structure of the head element forming such an inkjet head. FIG. 13 is a perspective view showing a structure of a conventional head element, and FIG. 14 is a perspective view showing the structure of the head element cut along a section line S of FIG. 13.

A method of manufacturing a conventional head element will be described. A piezoelectric substrate 101 polarized along its depth direction is diced to form a plurality of trenches. The plurality of trenches will be ink chambers 104. On an inner wall of ink chamber 104, an electrode 105 is formed. Then, on the inner wall of ink chamber 104, an electrode protection film (not shown) of about 10 μm in thickness is formed to cover electrode 105. A rear end portion of ink chamber 104 (on the side opposite to the side to be in contact with a nozzle plate) is filled with a conductive material (not shown) to be conducted to electrode 105.

On piezoelectric substrate 101, a cover member 102 is attached to cover ink chambers 104. Cover member 102 has a common ink chamber 103 formed therein. Common ink chamber 103 is communicated with all the ink chambers 104 of piezoelectric substrate 101, and from common ink chamber 103, ink is supplied to each of ink chambers 104.

By adhering cover member 102 on piezoelectric substrate 101, a head element 100 is formed. When a voltage in accordance with the print data is applied to electrode 105, the wall portion of ink chamber 104 deforms. Consequently, the ink filled in ink chamber 104 is pressurized, and the ink is forced out from ink chamber 104.

The piezoelectric inkjet head as described above has a characteristic that it easily allows grayscale printing, as it is possible to control the pressure to be applied to the ink and hence the volume of ink droplets to be ejected, by controlling deformation of the piezoelectric body through voltage adjustment. When four colors of ink are used, four head elements 100 are integrated, and when six colors of ink are used, six head elements 100 are integrated, to form a head unit.

FIG. 15 is a perspective view of a conventional head unit having a plurality of head elements integrated. In a head unit 200 such as shown in FIG. 15, it is necessary to arrange each head element 100 relative to a head holding member 106 with high accuracy. When each head element 100 is not arranged at a prescribed position with respect to head holding member 106, the ink would not land on a prescribed spot of the recording paper, resulting in blurring and unsatisfactory image quality.

Positional deviation of head element 100 involves positional deviation in the direction of X, Y and Z axes as well as deviation in α, β and γ components representing rotation about these axes, as shown in FIG. 15. Unless positioning with respect to these six axes has sufficient accuracy, image quality would be unsatisfactory as described above.

In this regard, Japanese Patent Laying-Open No. H9-174833 describes an inkjet head in which a nozzle plate common to a plurality of head elements is adhered on a front surface and on a frame surface of the head elements. In the inkjet head, as the common nozzle plate is adhered, the ink landing accuracy is determined by the processing accuracy of the nozzle plate and the attitude of the plurality of inkjet heads integrated by the common nozzle, even if relative positions of the head elements are deviated from each other. Thus, it becomes possible to ensure high landing accuracy in a simple manner.

In a system for fabricating a wiring pattern, a color filter or the like incorporating the inkjet head, nozzle pitch of the inkjet head is adjusted to match pixel pitch or picture element pitch by arranging the inkjet head inclined by θ° relative to the printing direction.

Patent Document 1: Japanese Patent Laying-Open No. 9-174833

DISCLOSURE OF THE INVENTION

Problems to be Solved by the Invention

When a common nozzle plate is to be adhered to a plurality of head elements, however, it is necessary to adjust relative positions of the head elements to each other with high accuracy.

FIG. 16 is a front view showing the relative positions of openings of ink chambers and nozzle holes. Assume, by way of example, that ink chamber 104 has the height of 80 μm and the depth of 200 μm. When an electrode protection film having a thickness of 10 μm is formed on an inner wall of ink chamber 104, the opening of ink chamber 104 comes to have the dimension of 60 μm×180 μm.

When the nozzle plate to be adhered has the thickness of 50 μm and nozzle hole 116 has an inlet diameter of 40 μm and outlet diameter of 20 μm, it follows that the plurality of head elements must be positioned with the accuracy of ±10 μm in the width direction of ink chamber 104 in order to have the inlet diameter of nozzle plate positioned within the opening of ink chamber 104.

When each head element 100 is arranged and fixed at a prescribed position on a head holding member 106 formed as a frame, generally, an adhesive is used for fixing. At the time of adhesion, it is necessary to fix and adhere each head element 100 while maintaining the elements in a state adjusted within the prescribed accuracy. To have an adjustment margin for adhering head element 100, direct contact between head holding member 106 and each head element 100 is avoided, that is, a prescribed space 107 is provided between head holding member 106 and each head element 100.

At the time of fixing with an adhesive, the adhesive is filled in the space 107 between head holding member 106 and each head element 100, as the adjustment margin. Here, each head element 100 may be deviated in position, because of curing and shrinkage of the adhesive or because of expansion/ shrinkage resulting from difference in thermal expansion, leading to a problem that the positional accuracy after fixing with adhesive goes out of the tolerable range.

Further, in the inkjet head of Japanese Patent Laying-Open No. 9-174833 mentioned above, the front surface of head holding member 106 and the front surface of head element 100 are flush, and the nozzle plate is adhered to both of these. Therefore, the nozzle plate has a large area, and hence, voids and dusts tend to enter when the nozzle plate is adhered. These may result in formation of a bypass between ink chambers 104, which has an adverse effect on ink emission.

Further, in order to remove droplets adhered on the surface of the nozzle plate, the surface of nozzle plate is wiped with a rubber-like wiper. Here, the larger the area of nozzle plate, the larger the area to be wiped, and the larger the area that needs maintenance. When the nozzle plate is provided to cover holding member 106, the area that needs maintenance increases. When the nozzle plate is formed to cover head elements 100 only, there arises another problem that the droplets on the nozzle plate tend to adhere on the head holding member.

The present invention was made to solve the above-described problems and its object is to provide an inkjet head allowing adhesion of a nozzle plate common to a plurality of head elements with high accuracy, as well as to provide a method of manufacturing the same.

Means for Solving the Problems

The present invention provides an inkjet head, including a head unit formed by fixing a plurality of head elements to each other, and a nozzle plate fixed on the head unit. The head element has a pair of main surfaces and a front surface positioned between the pair of main surfaces, and the front surface has a plurality of openings respectively communicated with a plurality of ink chambers provided inside. The head elements forming the head unit are fixed with their main surfaces brought into contact with each other. The nozzle plate is brought into contact with a front surface of the head unit across all the head elements forming the head unit, and has nozzle holes provided at positions corresponding to the openings.

By this structure, the main surfaces of the head elements are brought into contact and fixed on each other, and therefore, accurate positioning of head elements relative to each other becomes possible in a simple manner. A nozzle plate common to all the head elements is attached to the head unit including the head elements thus positioned accurately and, therefore, it is possible to easily attain positional accuracy of ink landing, and to have the head unit and the nozzle plate in contact with each other, without any gap therebetween.

In the inkjet head, preferably, the head element includes a head chip providing the plurality of openings and the ink chambers, and a heat radiating member in contact with the head chip. When the head elements are fixed directly to each other, radiation of internal heat becomes difficult. However, in this structure, as the heat radiation member is provided in each head element, it becomes possible to effectively radiate the heat generated at the head chip. This allows high-frequency driving that generates much heat.

In the inkjet head described above, more preferably, the head chip has a pair of parallel main surfaces, the heat radiating member has a plate-shaped portion, the plate-shaped portion is in contact with one of the main surfaces of the head chip, and the heat radiating member is interposed between each head chip of each head element forming the head unit. In this structure, as the heat radiating member is interposed between each head chip, the heat generated at the head chip can more effectively be radiated.

In the inkjet head, more preferably, the heat radiating member is formed of a ceramic material. In this structure, more accurate processing of the heat radiating member becomes possible and, therefore, positional accuracy of the head elements relative to each other can further be improved.

In the inkjet head, more preferably, the heat radiating member is formed of aluminum nitride. In this structure, more accurate processing of the heat radiating member becomes possible and, in addition, as the piezoelectric material forming the head chip and aluminum nitride have thermal expansion coefficients close to each other, influence of temperature change experienced at the time of heating for adhesion and the like can be minimized.

More preferably, the inkjet head further includes a head unit holding member surrounding the pair of main surfaces and opposite side surfaces of the head unit and holding the head unit, and the front surface of the head unit is protruded forward from a front surface of the head unit holding member. Preferably, length of the protrusion is at least 1 mm.

In this structure, the front surface of the head unit is protruded from the head unit holding member. Therefore, the nozzle plate is not in contact with the head unit holding member. When the nozzle plate is adhered, it has to be adhered only to the front surface of the head unit, and the area of adhesion of the nozzle plate can be made smaller. As a result, entrance of voids or bubbles between the head unit and the nozzle plate is less likely, and troubles caused by such voids and the like can be avoided. Though it is necessary to scrape off the ink adhered on the surface of nozzle plate by means of a rubber-like wiper or the like, the front surface of nozzle plate is protruded forward from the head unit holding member, as the head unit is protruded. Therefore, the wiper that scrapes off the ink is not brought into contact with the head unit holding portion, and hence, adhesion of the removed ink to the head unit holding member can be prevented. When the length of protrusion of the head unit is made 1 mm or longer, such effect can be attained more reliably.

More preferably, the inkjet head described above further includes a manifold attached across and in contact with side surfaces of the plurality of head elements forming the head unit, wherein the manifold has an ink supply pipe supplying ink to the ink chamber, and a surface of the manifold in contact with the head unit has such a shape that is in contact with a side surface of the head unit without any gap. In this structure, the manifold is in contact with the side surface without any gap therebetween, and therefore, it is possible to position each head element forming the head unit accurately in the direction of the side surface.

The head elements forming the head unit are fixed stepwise to each other so that steps are formed at opposite side surfaces of the head unit, the manifold is provided on opposite side surfaces of the head unit, and the opposite side surfaces of the head unit are fixed on the head unit holding member with the manifold interposed. Therefore, even when the head elements are fixed in a stepwise pattern, the head elements can be positioned accurately.

In the inkjet head, more preferably, a front surface of the manifold and the front surface of the head unit are flush, and the nozzle plate is fixed in contact with the front surface of the manifold and the front surface of the head unit. In this structure, the front surface of the head element and of the manifold may have any planer shape, regardless of the shape of the front surface of the head unit. Therefore, there is no restriction on the planer shape of the nozzle plate.

According to an aspect, the present invention provides a method of manufacturing an inkjet head, including the steps of forming a plurality of head elements having a pair of main surfaces and a front surface positioned between the pair of main surfaces, the front surface having a plurality of openings respectively communicated with a plurality of ink chambers provided inside; forming a head unit by fixing the plurality of head elements with each other; performing, on the head unit, a process for providing a protection film for protecting an electrode provided on an inner wall of the ink chamber; and adhering a nozzle plate on the front surface of the head unit that has been subjected to the process for providing the protection film.

According to the method of manufacturing the inkjet head, the main surfaces of head elements are brought into contact and fixed on each other, and therefore, accurate positioning can be attained easily. Further, as the common nozzle plate is fixed on the front surface, it is possible to attach the nozzle plate at an accurate position.

As a protection film for protecting the electrode, an organic film such as a parylene film is generally used. When the process for providing the protection film is performed before forming the head unit, it follows that the protection film is interposed when the main surfaces of the head elements are brought into contact and fixed on each other. As a result, accuracy of the unit is affected by the film thickness accuracy of the protection film, and the accuracy would possibly be degraded. When the process for providing the protection film is performed after forming the head unit, the influence of protection film thickness is avoided, as the protection film does not exist between the head elements, and hence, a head unit of high accuracy can be formed.

The organic film generally used as the protection film is softer and more susceptible to damages than the head elements. Therefore, when the unit is formed, it may be damaged and lose its function as a protective film, or it may become difficult to ensure accuracy because of plastic deformation. Such problems can be avoided when the process for providing the protection film is performed after forming the head unit.

Further, contact strength of the protection film on the head element is lower than the adhesion strength of head elements adhered to each other. When the process for providing the protection film is performed after forming the head unit, the head elements can be adhered directly to each other as the protection film does not exist between the head elements, and hence, firmer fixation can be attained.

According to another aspect, the present invention provides a method of manufacturing an inkjet head, including the steps of: forming a plurality of head elements having a pair of main surfaces and a front surface positioned between the pair of main surfaces, the front surface having a plurality of openings respectively communicated with a plurality of ink chambers provided inside; forming a head unit by fixing the plurality of head elements with each other; performing, on the head unit, a process for providing a protection film for protecting an electrode provided on an inner wall of the ink chamber; arranging manifolds supplying ink to the ink chamber on opposite side surfaces of the head unit that has been subjected to the process for providing the protection film; and adhering a nozzle plate on the front surface of the head unit and the manifolds.

According to the manufacturing method of the inkjet head, the main surfaces of the head elements are brought into contact and fixed to each other, and therefore, accurate positioning of these can be attained easily. Further, as the manifolds are attached to both side surfaces of the head unit, accurate positioning of the head elements in the direction of the side surface becomes possible. Further, as the common nozzle plate is fixed on the front surfaces of the manifold and the head unit, it is possible to attach the nozzle plate at an accurate position, even when the head elements are attached stepwise.

An organic film such as a parylene film is generally used as the protection film, and the parylene film may be formed by heating diparaxylylene as a dimmer under low pressure to thermally decompose the same to generate a radical gas, and by introducing the gas to the head unit. Though it is possible to form the parylene film in a very narrow region, considering the shape of the ink flow path of the inkjet head, the film thickness may vary gradually in accordance with the distance from the opening of the common ink chamber. When the parylene film is formed after the manifold is attached at the opening of the ink chamber, variation in film thickness would be more significant, resulting in variation of characteristics. When the process for providing the protection film is performed before attaching the manifold, such a problem can be avoided.

Effects of the Invention

According to the inkjet head and the manufacturing method of the present invention, it is possible to adhere a common nozzle plate with high accuracy to the head unit formed by a plurality of head elements.

DESCRIPTION OF THE REFERENCE SIGNS

Figure 1:
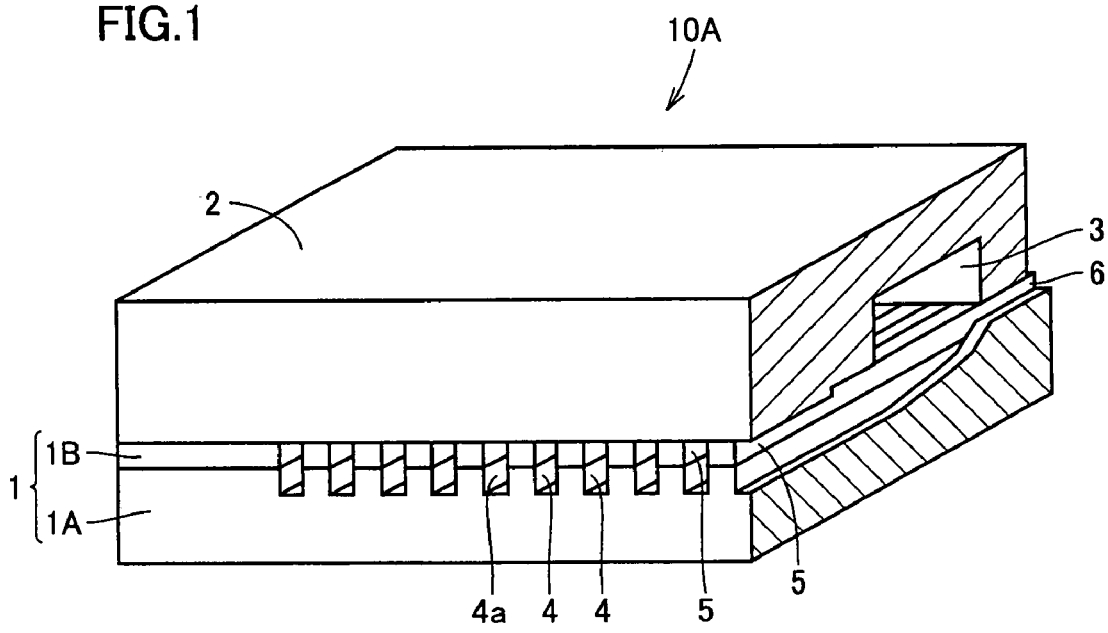
FIG. 1 is a perspective view showing a structure of a head chip in accordance with an embodiment of the present invention.

1 piezoelectric substrate, 2 cover member, 4 ink chamber, 4*a* opening, 5 electrode, 7 head unit, 10 head element, 10A head chip, 10B heat radiating member, 12 manifold, 15 head unit holding member, 16 nozzle hole, 17 nozzle plate, 20 inkjet head, F front surface, M main surface.

Best Modes for Carrying out the Invention

In the following, an embodiment of the present invention will be described with reference to FIGS. 1 to 12. The inkjet head of the present embodiment includes a head unit 7 formed by fixing a plurality of head elements 10 with each other, and a nozzle plate 17 fixed on head unit 7.

Head element 10 has a pair of main surfaces M and a front surface F positioned between the pair of main surfaces M. On front surface F, there are a plurality of openings 4*a*, which are respectively communicated with a plurality of ink chambers 4 provided inside. Head elements 10 are fixed to each other with respective main surfaces M being in contact with each other, to form head unit 7. Nozzle plate 17 is brought into contact with the front surface of head unit 7 across all the head elements 10 forming the head unit 7, and at positions of the plate corresponding to openings 4*a*, nozzle holes 16 are opened.

FIG. 1 is a perspective view showing a structure of the head chip in accordance with the present embodiment. Head element 10 includes a head chip 10A and a heat radiating member 10B. Head chip 10A is formed through the following steps. First, a PZT (lead zirconate titanate) substrate 1A is adhered to a PZT substrate 1B, to from a piezoelectric substrate having the thickness, for example, of about 0.9 mm. Next, a plurality of parallel trenches are formed on piezoelectric substrate 1 by dicing. These trenches each will be the ink chamber 4.

On an inner wall of ink chamber 4, an electrode 5 is formed by vapor deposition, sputtering, plating or the like. Suitable material for electrode 5 includes aluminum and copper. When electrode 5 is formed by the method described above, electrode 5 is also formed on portions other than the inner wall of ink chamber 4, such as an upper surface of a partition wall separating adjacent ink chambers 4 from each other. As a result, adjacent ink chambers 4 come to be short-circuited. In order to electrically separate ink chambers 4 from each other, a surface of piezoelectric substrate 1 is ground, to remove electrode 5 formed on the partition wall separating ink chambers 4 from each other.

It is preferred that by this grinding process, a lower surface of piezoelectric substrate 1 and the upper surface of the partition wall separating ink chambers 4 from each other, that is, opposite surfaces of piezoelectric substrate 1, come to have the flatness and parallelism of about 1 to 2 μm. On the rear end portion of electrode 5 (opposite to the side to be in contact with the nozzle plate), a connecting terminal 6 is formed to lead out the electrode 5.

A cover member 2 is adhered to piezoelectric substrate 1 to form ink chamber 4. Cover member 2 is integrated with piezoelectric substrate 1, and therefore, it is preferred that piezoelectric substrate 1 and cover member 2 have the same or similar coefficient of thermal expansion. Further, processability allowing processing with high accuracy comparable to that of piezoelectric substrate 1 is desirable. Free-machining ceramics or piezoelectric substrate satisfies these conditions. Cover member 2 is formed of such a material.

On the lower surface side of cover member 2, a common ink chamber 3 is formed. Common ink chamber 3 is communicated with all ink chambers 4 of each piezoelectric substrate 1, and penetrated to a side surface of head chip 10A. Cover member 2 should preferably have such a thickness that has sufficient strength even after it is processed to provide common ink chamber 3. In the present embodiment, cover member 2 has the thickness of 2 mm. From common ink chamber 3, ink is supplied to each ink chamber 4. After it is processed to provide common ink chamber 3, cover member 2 is also subjected to surface grinding, using the same grinding machine as used for processing piezoelectric substrate 1. Thus, opposite surfaces of cover member 2 can be processed with high accuracy. By way of example, flatness and parallelism of about 1 to 2 μm can be ensured for opposite surfaces of cover member 2. By adhering piezoelectric substrate 1 to cover member 2, head chip 10A is formed.

Head chips 10A are processed in a wafer state, and cut by a dicing machine into individual head chip 10A. Therefore, it is possible to attain high accuracy in widthwise length and squareness of head chip 10A. By way of example, positional accuracy when head chip 10A is cut by the dicing machine may be set to about 2 to 3 μm, and squareness of the cut surface to the piezoelectric substrate 1 may be set to 1 to 2 μm.

Figure 2:
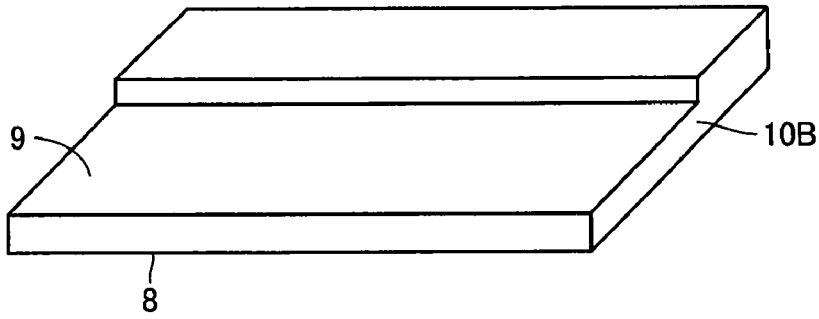
FIG. 2 is a perspective view showing a structure of a heat radiating member in accordance with an embodiment of the present invention.

FIG. 2 is a perspective view showing a structure of the heat radiating member in accordance with the present embodiment. Head chip 10A is next adhered to a stepped, plate-shaped heat radiating member 10B such as shown in FIG. 2. Heat radiating member 10B must have the following characteristics. (1) The heat generated when head chip 10A is driven at a high frequency can be radiated to the outside efficiently. (2) It allows highly precise processing, as the plurality of head chips 10A must be arranged and adhered accurately with heat radiating member 10B interposed. (3) It has the coefficient of thermal expansion same as or close to that of head chip 10A.

Materials that satisfy these required characteristics include ceramic materials including aluminum nitride, silicon carbide and alumina. Among these, aluminum nitride is most preferable in view of matching in thermal expansion coefficient and heat radiating characteristics. By grinding, heat radiating member 10B is processed such that a rear surface 8 and a mounting surface 9 for mounting head chip 10A come to have the parallelism and flatness of at most 3 μm and thickness tolerance of ±5 μm. In the present embodiment, heat radiating member 10B has the thickness of 1 mm at the mounting surface 9 for mounting head chip 10A.

Figure 3:
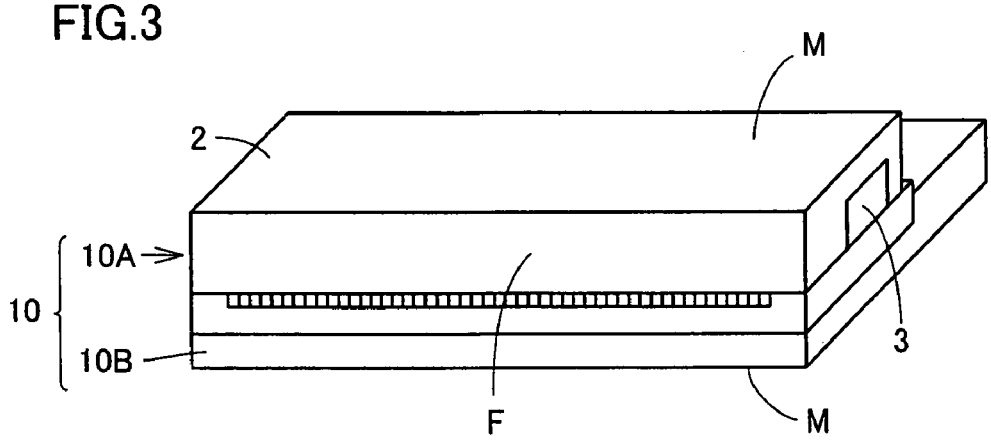
FIG. 3 is a perspective view showing a structure of a head element in accordance with an embodiment of the present invention.

FIG. 3 is a perspective view showing a structure of the head element in accordance with the present embodiment. An adhesive is applied to the mounting surface 9 for mounting head chip 10A of heat radiating member 10B, and head chip 10A is adhered. Consequently, a head element 10 such as shown in FIG. 3 is provided. In the present embodiment, head element 10 formed of heat radiating member 10B and head chip 10A has the thickness of 3.9 mm.

Here, heat radiating member 10B is formed such that the front surface of head chip 10A protrudes by about 50 μm from the front surface of heat radiating member 10B. The reason for this is that when the front surface of heat radiating member 10B protrudes from head chip 10A, a gap would result between nozzle plate 17 and the front surface of head chip 10A.

Figure 4:
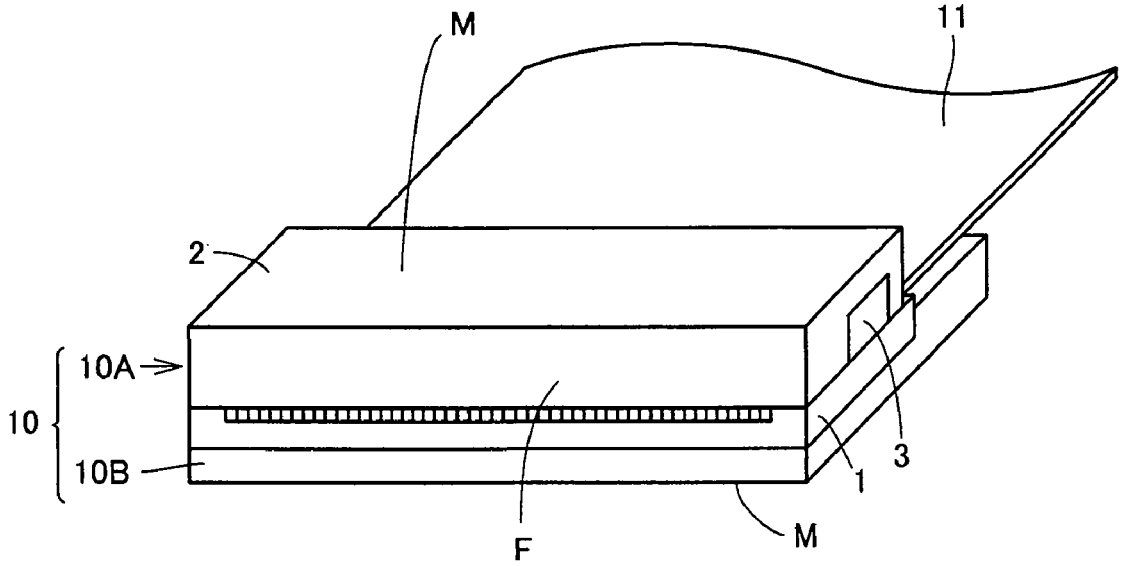
FIG. 4 is a perspective view showing a state in which a flexible wiring substrate is attached to the head element in accordance with an embodiment of the present invention.

FIG. 4 is a perspective view showing the head element in accordance with the present embodiment, having a flexible wiring board attached thereto. As can be seen from FIG. 4, a flexible wiring board 11 is connected to connecting terminal 6 (see FIG. 1) for leading out the electrode 5, formed at the rear end portion (opposite to the side to be in contact with the nozzle plate) of head element 10. Flexible wiring board 11 is connected to connecting terminal 6 with an anisotropic conductive resin (not shown) interposed. Thus, it becomes possible to drive head element 10 by applying a voltage from the outside to electrode 5 of head element 10.

Figure 5:
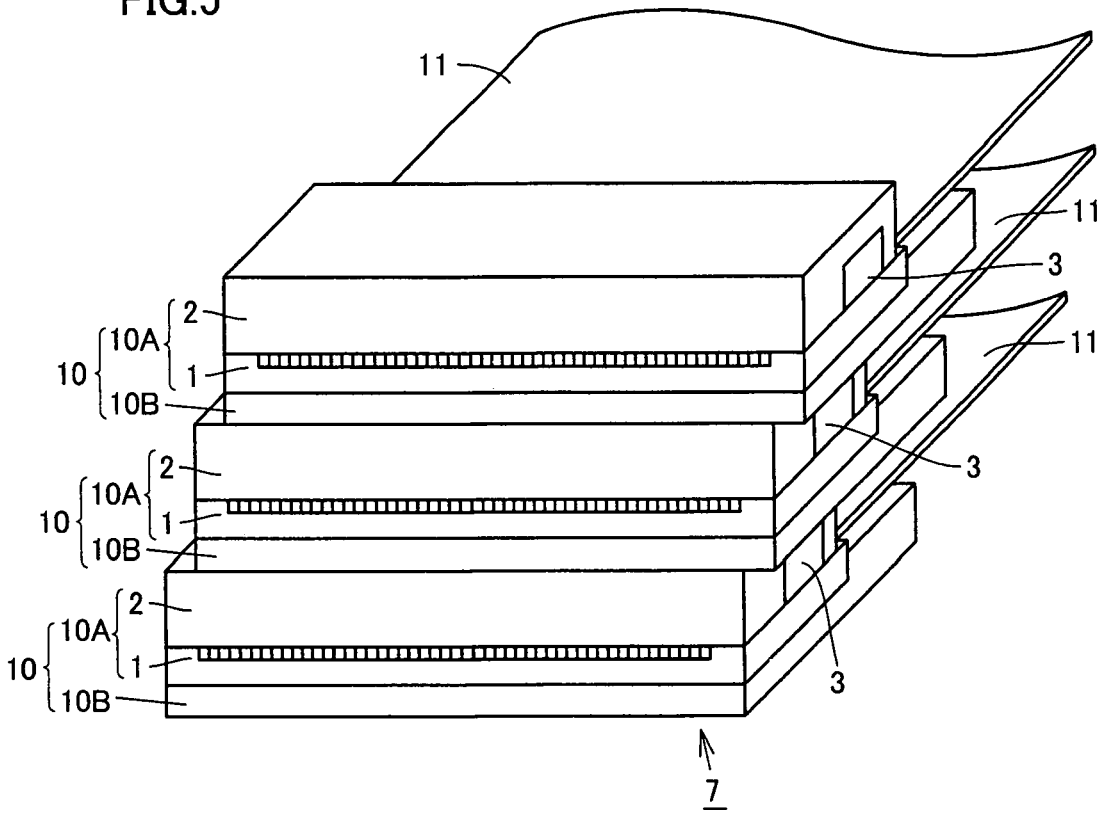
FIG. 5 is a perspective view showing a structure of a head unit formed by combining a plurality of head elements in accordance with an embodiment of the present invention.

FIG. 5 is a perspective view showing a structure of a head unit formed by combining a plurality of head elements. By adhering n (three in the example of FIG. 5) head elements 10 manufactured through the above-described steps and having flexible wiring board 11 connected thereto, where n corresponds to the number of ink colors to be ejected, a multi-head body is formed. Here, head elements 10 are adhered with main surfaces M brought into contact and adhered to each other. As a result, it becomes possible to accurately define the relative position of head elements to each other in the direction of the normal of main surface M and the relative angle in the direction along the main surface M. Further, the main surfaces of head chip 10 and heat radiating member 10B are processed with high accuracy as described above and, therefore, the main surface of head element 10 also has very high accuracy. As a result, even when a number of head elements 10 are adhered one after another, it is still possible to form a head unit 7 of high accuracy.

Further, when head elements 10 are combined, head chips 10A and heat radiating members 10B forming the head elements 10 are positioned alternately. Therefore, the heat generated at head chip 10A can efficiently be radiated by heat radiating member 10B. Particularly, when the head chip 10A is driven at a high frequency, the amount of generated heat increases. Even in that case, it is possible to keep the temperature of head chip 10A at a prescribed temperature or lower.

In the specification and claims, the main surface refers to substantially the largest outer surface forming the member, and the corresponding opposite surface. The main surface is not necessarily a perfectly flat surface, and it may have a recess/protrusion such as a trench or step that match a corresponding main surface facing thereto.

There is a limit in the pitch of trench processing, when ink chambers 4 are formed. Therefore, when a nozzle pitch smaller than the limit of trench processing is necessary such as in the case of a fine wiring pattern or a color filter, the direction in which the nozzle holes of the inkjet head are aligned is inclined by a prescribed angle from the direction of printing, so as to be adjusted to the pixel pitch or picture element pitch. Particularly, when it is necessary to eject ink of different color to each pixel element as in the case of a color filter, the nozzle pitch must be small and the landing accuracy of the ink must be very high.

Therefore, in the inkjet head in accordance with the present invention, for multi-color printing, head elements 10 corresponding to respective colors of ink are combined. When a color filter for a liquid crystal panel is to be formed, an inclination angle that corresponds to the picture element pitch is calculated. Then, ejection holes of the head chips are inclined to the inclination angle. Head elements 10 are arranged shifted from each other, such that ink droplets land on one extended line when fed along the direction of printing with this inclination angle. In FIG. 5, three head elements 10, corresponding to the number of ink colors, are combined to form a multi head body.

Next, a process for forming a protection film for protecting electrode 5 is performed, on head unit 7 provided by combining head elements 10. As the protection film, an organic film such as a parylene film is generally used. When the process for providing the protection film is performed before forming the head unit, it follows that the protection film is interposed when the main surfaces M of head elements 10 are brought into contact and fixed on each other. As a result, accuracy of the unit formation is affected by the film thickness accuracy of the protection film, possibly degrading the accuracy. When the process for providing the protection film is performed after forming the head unit as in the present embodiment, the influence of protection film thickness is avoided, as the protection film does not exist between the head elements, and hence, head unit 7 of high accuracy can be formed.

The organic film generally used as the protection film is softer and more susceptible to damages than head elements 10. Therefore, when the unit is formed, it may be damaged and lose its function as a protective film, or it may become difficult to ensure accuracy because of plastic deformation. Such problems can be avoided when the process for providing the protection film is performed after forming the head unit.

Further, contact strength of the protection film on head element 10 is lower than the adhesion strength of head elements 10 adhered to each other. When the process for providing the protection film is performed after forming head unit 7, head elements 10 can be adhered directly to each other as the protection film does not exist between head elements 10, and hence, firmer fixation can be attained.

The parylene film is formed by heating diparaxylylene as a dimmer under low pressure to thermally decompose the same to generate a radical gas, and by introducing the gas to head unit 7. Though it is possible for form the parylene film in a very narrow region, considering the shape of the ink flow path of the inkjet head, the film thickness may vary gradually in accordance with the distance from the opening of common ink chamber 3. When the parylene film is formed after the manifold is attached at the opening of common ink chamber 3, variation in film thickness would be more significant, resulting in variation of characteristics. Therefore, in the present embodiment, the process for providing the protection film is performed before attaching manifold 12, in order to avoid such a problem.

Next, on a side surface of head unit 7 after the process for providing protection film, manifold 12 for supplying ink to head unit 7 is attached. On the side of head unit 7, side surfaces of head elements 10 are stepped as shown in FIG. 5. Manifold 12 is attached to the side surface of head unit 7 having such steps.

Figure 6:
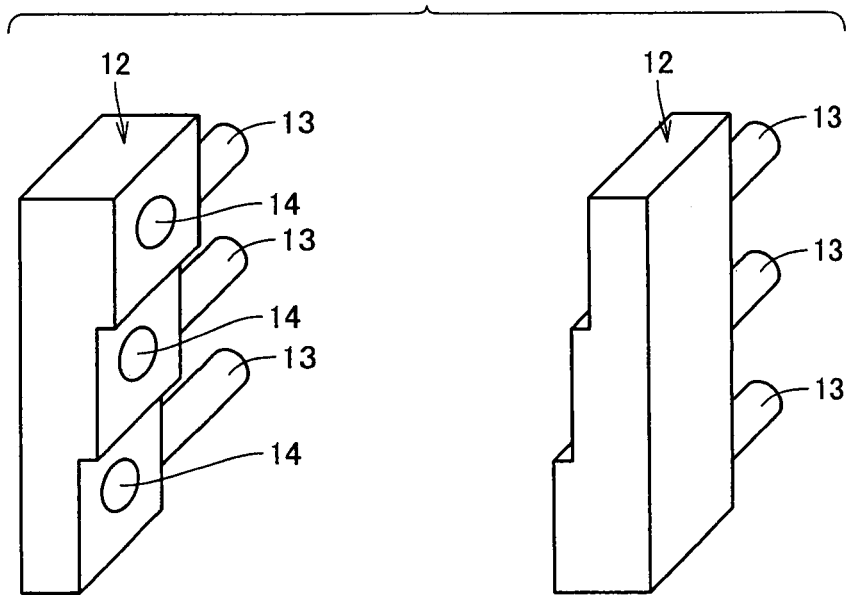
FIG. 6 is a perspective view showing a structure of a manifold in accordance with an embodiment of the present invention.

FIG. 6 is a perspective view showing the structure of the manifold in accordance with the present embodiment. Manifold 12 is formed to have such a shape that corresponds to the steps resulting from the process of multi-head formation, as shown in FIG. 6. It is preferred that each step is processed by grinding with the accuracy of 2 to 3 μm. At each step corresponding to each head element 10 of manifold 12, an opening 14 is formed. Opening 14 is communicated with a pipe 13. To pipe 13, corresponding ink is supplied.

Figure 7:
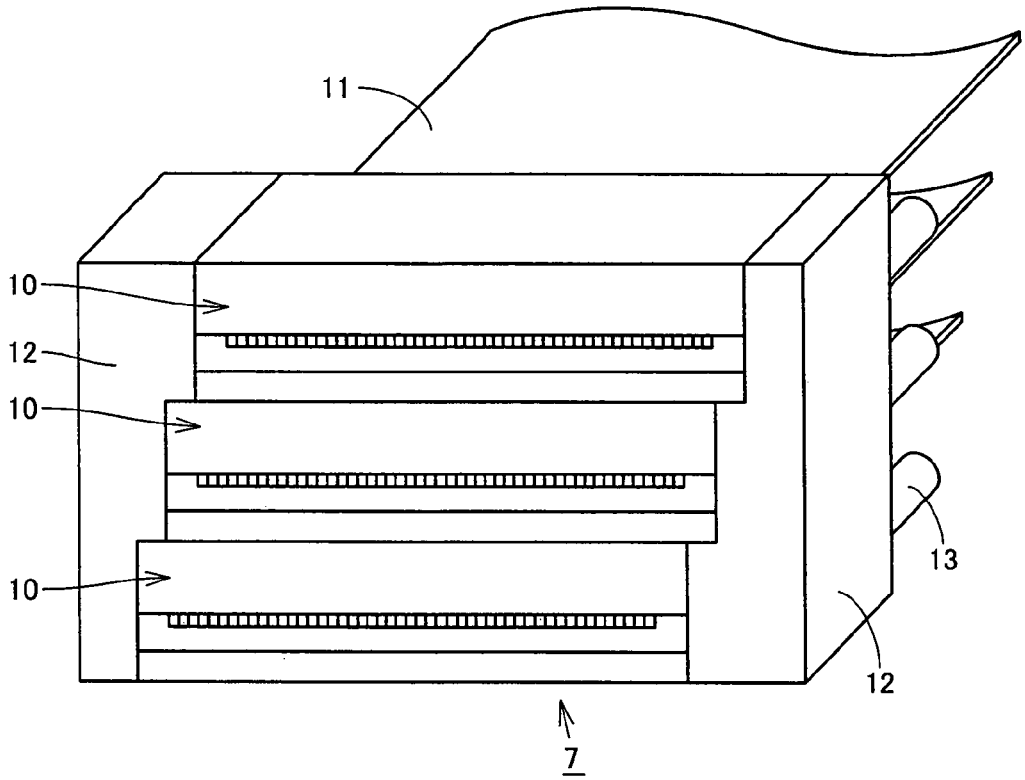
FIG. 7 is a perspective view showing a structure of a head unit having the manifold attached, in accordance with an embodiment of the present invention.

FIG. 7 is a perspective view of the head unit with manifolds of the present embodiment attached. As manifolds 12 are attached to the side surfaces of head unit 7, openings 14 of manifolds 12 come to be communicated with common ink chamber 3 that is opened at opposite side surfaces of corresponding head element 10. This makes it possible to supply ink from pipe 13 through opening 14 of manifold 12 to each common ink chamber 3 of head element 10. As manifolds 12 are joined to both side surfaces of head unit 7, the influence of thermal expansion on head unit 7 is not so significant. Therefore, the manifold may be formed of metal materials. The front surface of manifold 12 is processed to be flush with the front surface of head unit 7 when attached to head unit 7.

Figure 8:
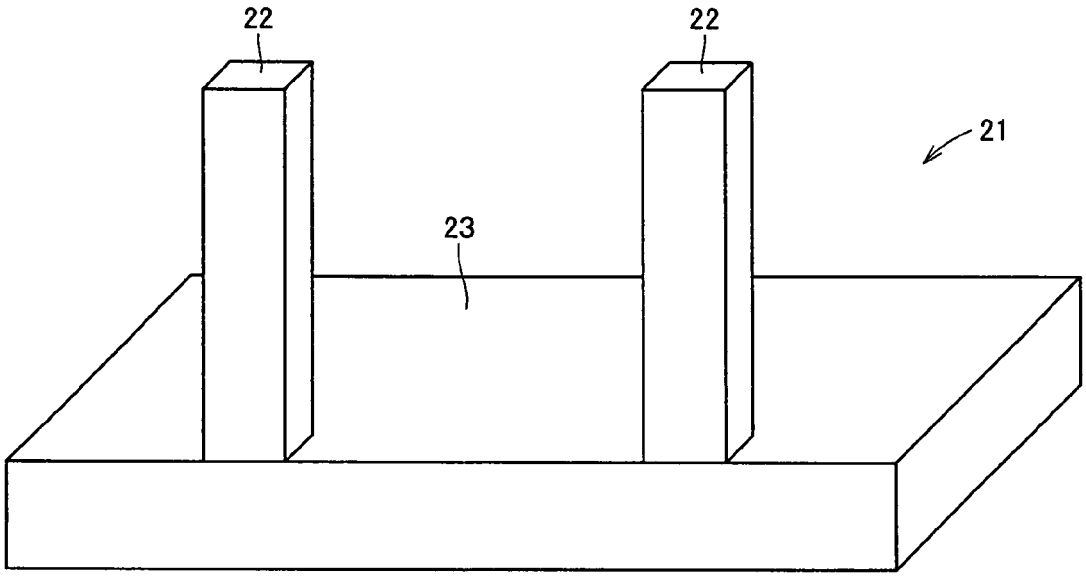
FIG. 8 is a perspective view of a jig used in an embodiment in accordance with the present invention.
Figure 9:
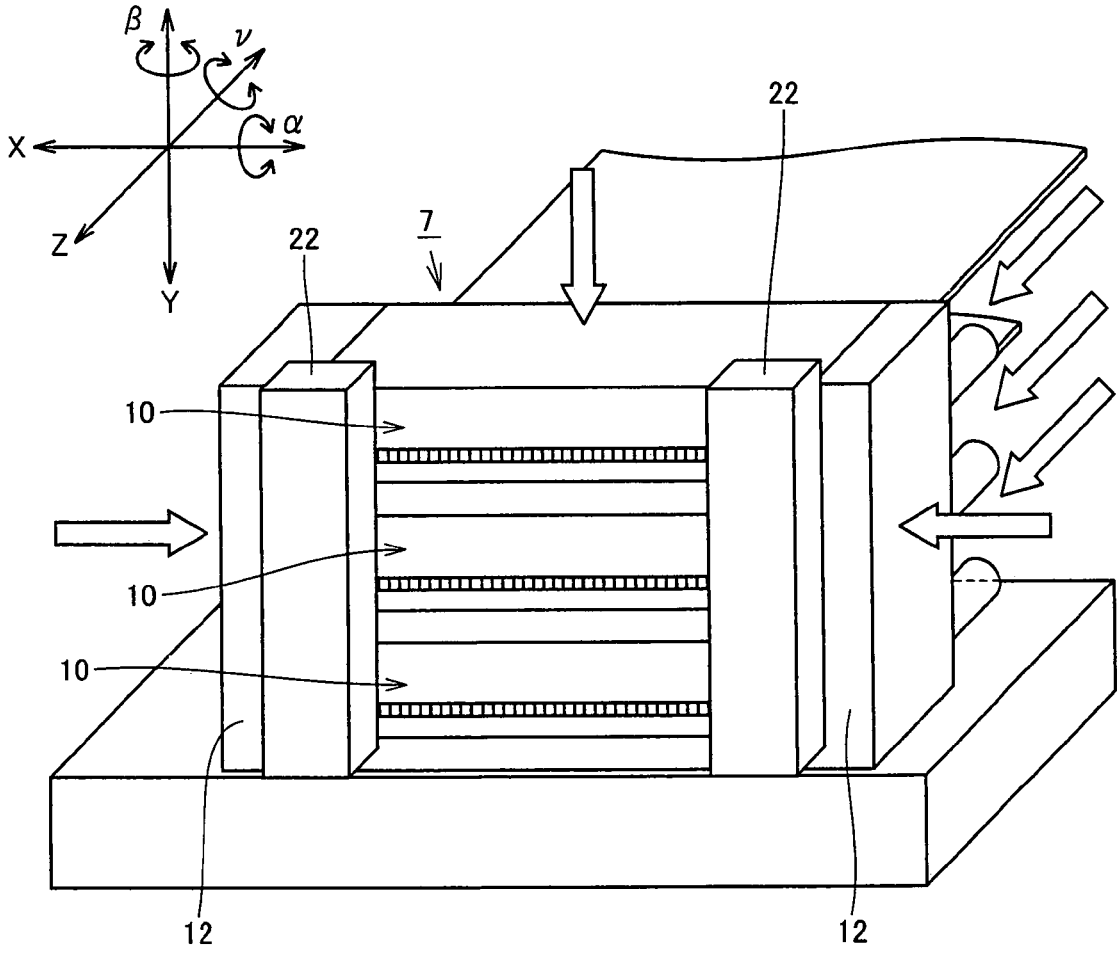
FIG. 9 is a perspective view showing a step of attaching the manifold to the head unit in accordance with an embodiment of the present invention.

In the following, the process for forming the multi-head body of inkjet head and the method of joining manifold 12 will be described with reference to FIGS. 8 and 9. FIG. 8 is a perspective view of a jig used in the present embodiment, and FIG. 9 is a perspective view showing a step of attaching the manifolds to the head unit in accordance with the present embodiment.

An assembly jig 21 such as shown in FIG. 8 is fabricated. Assembly jig 21 consists of a base member 23 and a pair of prismatic poles 22, which are all formed of a ceramic material. The pair of poles 23 are erected on a surface of base material 23, and it is preferred that squareness between the surface of base member and pole 22 has the accuracy as high as about 1 to 2 μm.

Next, the plurality of (three in the example of FIG. 9) head elements 10 are arranged on base member 23 of assembly jig 21. Head elements 10 are pressed to the surface of base member 23, while front surfaces of head elements 10 as the surface to be adhered to the nozzle plate are pressed to poles 22. In this manner, head elements 10 is regulated in Y, Z, α, β and γ directions.

Thereafter, manifolds 12 processed with high accuracy to have steps are pressed to opposite surfaces of a plurality of (three in FIG. 9) head elements 10. This regulates the X direction. The front surface of manifold 12 is processed to be flush with the front surface of head unit 7. Since head chip 10A, heat radiating member 10B and manifold 12 are each processed with high accuracy, positioning with the accuracy of up to 5 μm is possible in Y, Z, α, β and γ directions, simply by pressing to assembly jig 21.

Further, simply by pressing manifolds 12 to opposite surfaces, positioning with the accuracy of up to 5 μm is possible also in the X direction. By adhering and fixing head elements 10 and manifolds 12 with each other in this state, the multi-head body of inkjet head can be provided with high accuracy. In the present embodiment, three head elements 10 are arranged as shown in FIG. 9 and, therefore, the thickness is 3.9 mm×3.

Figure 10:
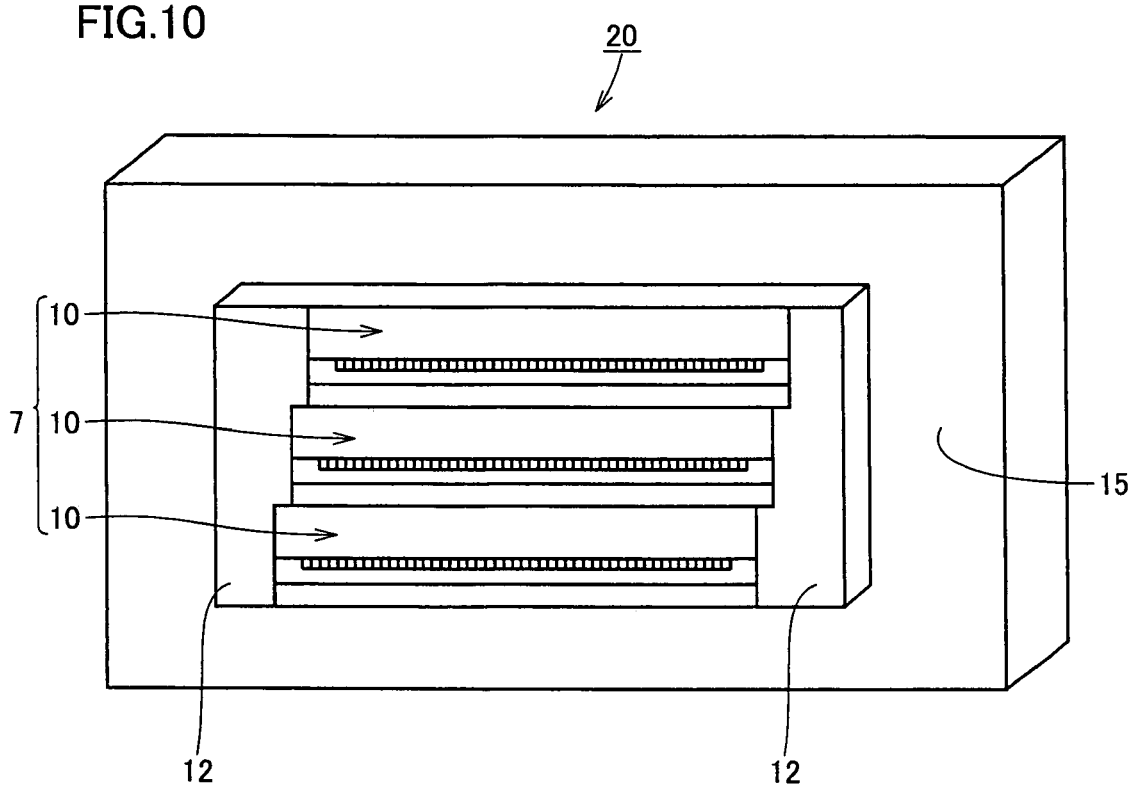
FIG. 10 is a perspective view showing a head unit holding member holding the head unit with the manifold attached, in accordance with an embodiment of the present invention.

FIG. 10 is a perspective view showing a head unit holding member in accordance with the present embodiment, holding the head unit with manifolds attached. Next, as shown in FIG. 10, head unit 7 as a multi-head body is attached to a head unit holding member 15. Head unit holding member 15 is a plate-shaped member having a rectangular opening. Head unit 7 with manifolds 12 attached on opposite sides is inserted to the opening of head unit holding member 15 and held by head unit holding member 15.

Therefore, it follows that the main surface M of head unit 7 is directly held by head unit holding member 15, while side surfaces of head unit 7 are held with manifolds 12 interposed. Here, the front surfaces of head unit 7 and manifolds 12 are adhered and fixed protruded forward by about 1 mm from the front surface of head unit holding member 15. In this manner, a multi-ink inkjet head 20 is formed.

Figure 11:
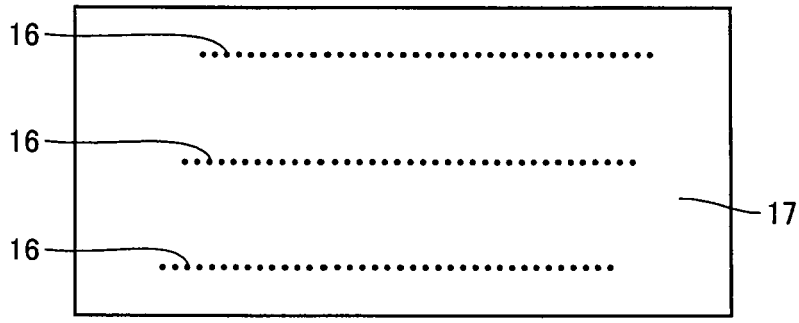
FIG. 11 is a front view showing a structure of a nozzle plate in accordance with an embodiment of the present invention.

FIG. 11 is a front view showing a structure of the nozzle plate in accordance with the present embodiment. Nozzle plate 17 has a rectangular shape, and has a plurality of nozzle holes 16 that correspond to the openings at the front surface of head chip 10A. In the present embodiment, head unit 7 has three head chips 10A. As the nozzle plate 17 is a common plate covering all the head chips 110A, nozzle holes 16 are provided in three rows.

Figure 12:
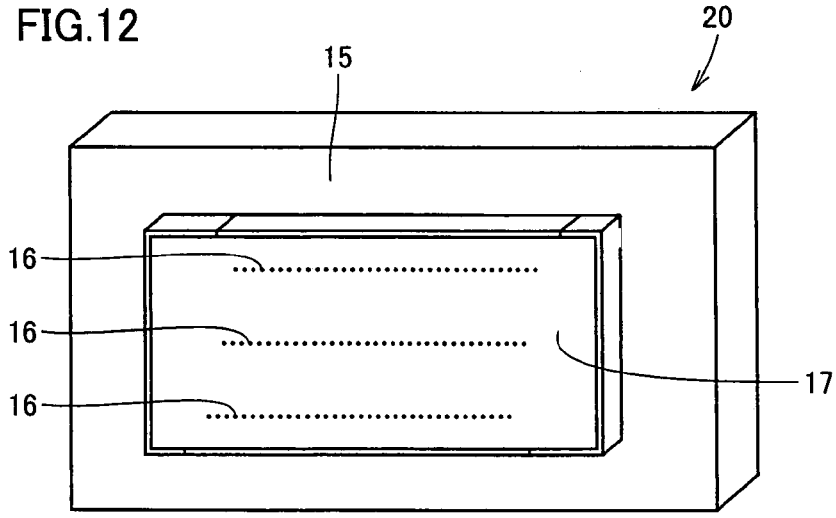
FIG. 12 is a perspective view showing a structure of an inkjet head in accordance with an embodiment of the present invention.
Figure 13:
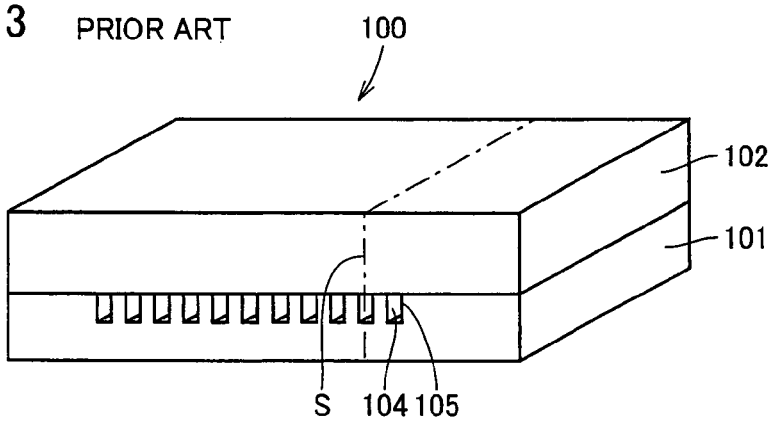
FIG.13 PRIOR ART
FIG. 13 is a perspective view showing a structure of a conventional head element.
Figure 14:
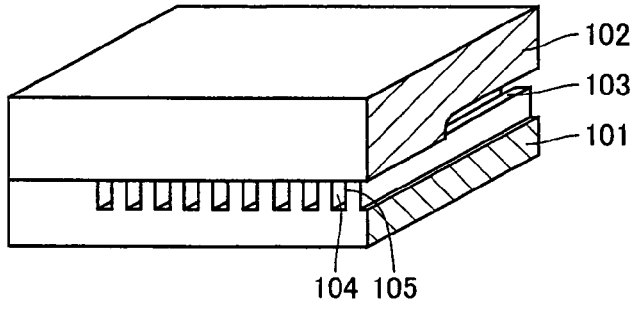
FIG.14 PRIOR ART
FIG. 14 is a perspective view showing the structure of the conventional head element taken along a section line S of FIG. 13.
Figure 15:
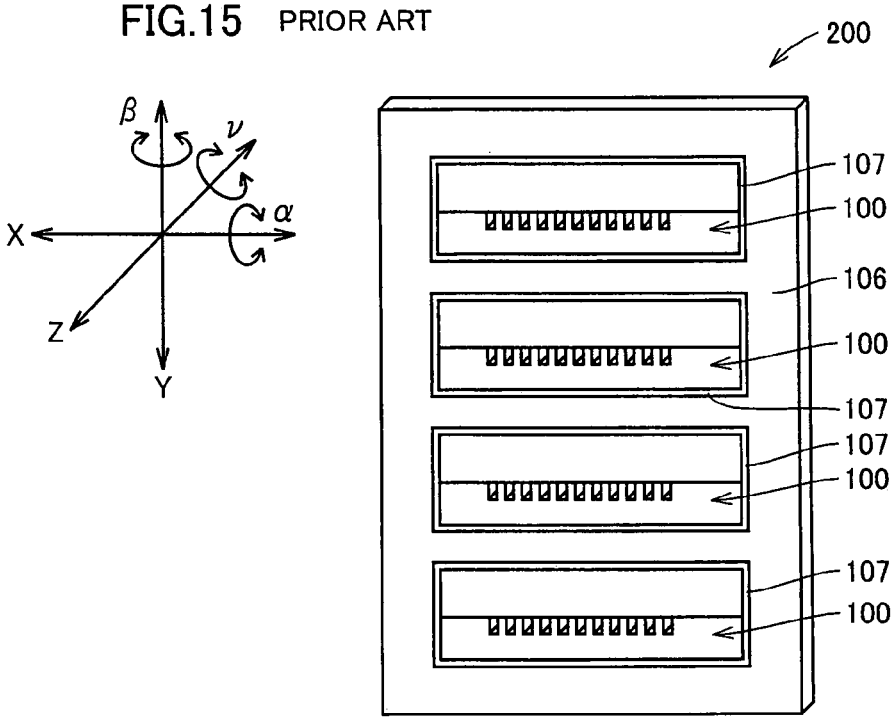
FIG.15 PRIOR ART
FIG. 15 is a perspective view showing a conventional head unit formed by integrating a plurality of head elements.

FIG. 12 is a perspective view showing a structure of the inkjet head in accordance with the present embodiment. As can be seen from FIG. 12, by adhering the rectangular nozzle plate 17 to the front surfaces of head unit 7 and manifolds 12, inkjet head 20 is completed. On the surface of nozzle plate 17, an ink-repellant film is formed. In the present embodiment, the width of nozzle plate 17 is made approximately the same as the height of head unit 7, that is, 3.9 mm×3. Specifically, nozzle plate 17 is adapted to have the size corresponding only to the front surfaces of head unit 7 and manifolds 12, and therefore, it is not in contact with head unit holding member 15. Thus, the area of nozzle plate 17 can be made small. Therefore, it is possible to adhere the nozzle plate 17 easily.

Figure 16:
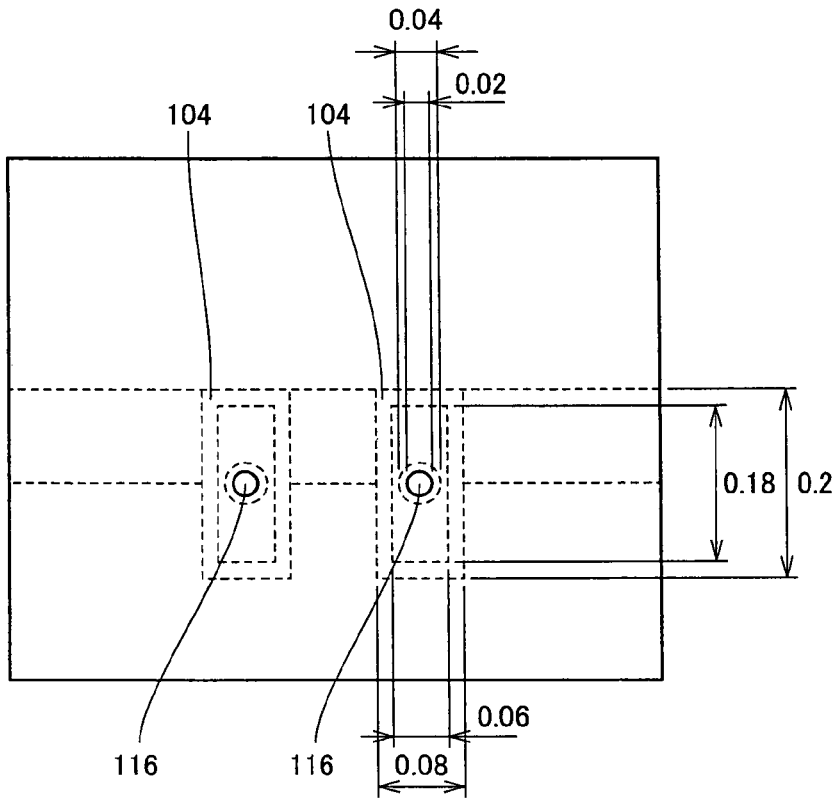
FIG. 16 is a front view showing relative positions of the opening of an ink chamber and nozzle hole.

Here, in connection with adhesion of nozzle plate 17 to the integrated body of n elements (three in FIG. 12), assume that the dimension of ink chamber 4 (104) is 80 μm in width and 200 μm in depth, as shown in FIG. 16. When the electrode protection film having the thickness of 10 μm is formed on the inner wall of ink chamber 4, the dimension of opening 4*a* of ink chamber 4 comes to be 60 μm×180 μm. Assuming that the nozzle plate 17 to be adhered has the dimension of 50 μm in thickness, inlet diameter of 40 μm and outlet diameter of 20 μm, it is necessary that the plurality of head elements 10 must be positioned with the accuracy of ±10 μm, in the width and depth directions of ink chamber 4, in order that the inlet diameter of nozzle plate 17 is positioned within the opening 4*a* of ink chamber 4. Inkjet head 20 in accordance with the present embodiment allows relative positioning of each head chip 10A with the accuracy of up to about 5 μm, and therefore, nozzle plate 17 for integrated body of n elements (three in the figure) can be adhered with the inlet diameter of nozzle plate 17 being within opening diameter 4*a* of ink chamber 4.

Further, on the surface of nozzle plate 17, ink-repellant film is formed, and therefore, ink droplets adhered near the nozzle holes 16 when the ink is ejected can easily be removed by contact-wiping by a rubber-like wiper. Here, the front surface of head unit 7 as a multi-head body is adhered protruded forward by 1 mm from the front surface of head unit holding member 15. Therefore, the rubber-like wiper is in contact only with the nozzle plate portion 17 and it scrapes off the adhered ink droplets, while it is not in contact with head unit holding member 15. Therefore, the area to be wiped is small, and the area that needs maintenance can be made small. Further, the scraped ink does not adhere to the front surface of head unit holding member 15, and hence, ink smudge can be prevented.

Though it depends on the shape and material of rubber-like wiper, when the amount of protrusion of head unit 7 is smaller than 1 mm, it is possible that the wiper also comes into contact with head unit holding member 15 and the scraped ink droplets adhere on head unit holding member 15. Therefore, it is preferred that head unit 7 is protruded by at least 1 mm from head unit holding member 15.

Further, smaller size of nozzle plate 17 leads to smaller wiping area and simpler maintenance. In addition, smaller maintenance area makes the whole apparatus more compact.

In inkjet head 20 of multi-head type fabricated in the above-described manner, when a voltage in accordance with the print data is applied to electrode 5 through flexible wiring board 11 of each head element 10, the wall portion of corresponding ink chamber 4 deforms and presses the ink in ink chamber 4. As a result, the ink is ejected from nozzle hole 16.

In the embodiment described above, in inkjet head 20, the inclination angle that corresponds to the picture element pitch of the color filter of a liquid crystal panel or the like, for example, is calculated and the n head elements 10 corresponding to the number of ink colors to be ejected are arranged inclined at such an angle. Therefore, it is possible to eject ink with the pitch of nozzle holes 16 matching the picture element pitch of color filter or the like.

In summary, the inkjet head of the present embodiment attains the following effects.

(1) Piezoelectric substrate 1, cover member 2, and heat radiating member 10B that are processed with high accuracy are adhered to each other to form head element 10, head elements as such are combined with their main surfaces M brought into contact with one another, and manifolds 12 are brought into contact with side surfaces of head unit 7 without any gap therebetween. Therefore, by simply pressing each head element 10 to a head element 10 serving as a reference and adhering the elements with each other, it is possible to join these elements without any positional deviation in X, Y and Z as well as in α, β and γ components as the rotational directions of these axes. As a result, it is possible to adhere nozzle plate 17 common to the plurality of head elements 10 while ensuring the accuracy of about ±5 μm.

(2) In order that piezoelectric substrate 1, cover member 2 and heat radiating member 10B have mutually matching coefficients of thermal expansion, cover member 2 is formed of a piezoelectric material, so that it has the same coefficient of thermal expansion as piezoelectric substrate 1. Further, as heat radiating member 10B requires highly accurate processing, a ceramic material is adopted. Specifically, it is formed of aluminum nitride, so that the coefficient of thermal expansion matches with that of piezoelectric substrate 1. This leads to improved thermal characteristics. Since piezoelectric substrate 1, cover member 2 and heat radiating member 10B are adapted to have mutually matching coefficients of thermal expansion, it becomes unnecessary to consider shrinkage of adhesive as it cures or expansion/shrinkage caused by the difference in thermal expansion coefficient.

(3) As piezoelectric substrate 1, cover member 2 and heat radiating member 10B are directly adhered to each other to form head element 10, thickness of each head element 10 can be made as thin as about 4 mm. Therefore, the thickness of head unit 7 is 4 mm×number of colors, whereby the area of the front surface of head unit 7 can be made small. This allows easy adhesion of nozzle plate 17. Further, as the nozzle plate 17 comes to have smaller area, wiping area becomes smaller, and maintenance becomes easier. As the maintenance area becomes smaller, the size of the apparatus can be made compact.

In the embodiment described above, as an example, three head elements 10 are used for forming head unit 7 and inkjet head 20. The number of head elements 10, however, may be changed appropriately in accordance with the intended use. Further, though manifolds 12 are provided on opposite sides of head unit 7 for positioning in the direction of the side surfaces in the embodiment described above, the manifold may be provided only on one side. If the ink is supplied by a different method, manifold 12 may be omitted.

The embodiments as have been described here are mere examples and should not be interpreted as restrictive. The scope of the present invention is determined by each of the claims with appropriate consideration of the written description of the embodiments and embraces modifications within the meaning of, and equivalent to, the languages in the claims.

INDUSTRIAL APPLICABILITY

By the inkjet head and manufacturing method thereof in accordance with the present invention, it is possible to adhere a common nozzle plate with high accuracy, to a head unit formed of a plurality of head elements.

The invention claimed is:

1. An inkjet head, comprising:

a head unit formed by fixing a plurality of head elements to each other, a manifold attached across and in contact with side surfaces of said plurality of head elements forming said head unit, and a nozzle plate fixed on said head unit; wherein said head element has a pair of main surfaces and a front surface positioned between said pair of main surfaces, said front surface having a plurality of openings respectively communicated with a plurality of ink chambers provided inside;

the head elements forming said head unit are fixed with their main surfaces brought into contact with each other;

said nozzle plate is brought into contact with a front surface of said head unit across all the head elements forming said head unit, and has nozzle holes provided at positions corresponding to said openings, and said head element includes a head chip providing said plurality of openings and ink chambers, and a heat radiating member in contact with said head chip.

2. The inkjet head according to claim 1, wherein said head chip has a pair of parallel main surfaces;

said heat radiating member has a plate-shaped portion, said plate-shaped portion being in contact with one of the main surfaces of said head chip; and said heat radiating member is interposed between each head chip of each head element forming said head unit.

3. The inkjet head according to claim 1, wherein said heat radiating member is formed of a ceramic material.

4. The inkjet head according to claim 3, wherein said heat radiating member is formed of aluminum nitride.

5. The inkjet head according to claim 1, further comprising:

a head unit holding member surrounding the pair of main surfaces and opposite side surfaces of said head unit and holding said head unit; wherein the front surface of said head unit is protruded forward from a front surface of said head unit holding member.

6. The inkjet head according to claim 5, wherein length of said protrusion is at least 1 mm.

7. The inkjet head according to claim 5, wherein said manifold has an ink supply pipe supplying ink to said ink chamber;

a surface of said manifold in contact with said head unit has such a shape that is in contact with a side surface of said head unit without any gap;

the head elements forming said head unit are fixed stepwise to each other so that steps are formed at opposite side surfaces of said head unit; and said manifold is provided on opposite side surfaces of said head unit, and the opposite side surfaces of said head unit are fixed on said head unit holding member with said manifold interposed.

8. The inkjet head according to claim 1, wherein said manifold has an ink supply pipe supplying ink to said ink chamber; and a surface of said manifold in contact with said head unit has such a shape that is in contact with a side surface of said head unit without any gap.

9. The inkjet head according to claim 8, wherein a front surface of said manifold and the front surface of said head unit are flush; and said nozzle plate is fixed in contact with the front surface of said manifold and the front surface of said head unit.

* * * * *